US008100666B2

(12) United States Patent
Makuszewski

(10) Patent No.: US 8,100,666 B2
(45) Date of Patent: Jan. 24, 2012

(54) ROTOR MOUNTING SYSTEM FOR GAS TURBINE ENGINE

(75) Inventor: Jerzy Makuszewski, Mississauga (CA)

(73) Assignee: Pratt & Whitney Canada Corp., Longueuil, QC (CA)

( * ) Notice: Subject to any disclaimer, the term of this patent is extended or adjusted under 35 U.S.C. 154(b) by 666 days.

(21) Appl. No.: 12/341,204

(22) Filed: Dec. 22, 2008

(65) Prior Publication Data

US 2010/0158699 A1 Jun. 24, 2010

(51) Int. Cl.
*F01D 25/00* (2006.01)
*F02C 7/00* (2006.01)
*B23P 11/00* (2006.01)

(52) U.S. Cl. ..... 416/244 A; 29/889.1

(58) Field of Classification Search ..... 415/244 A, 415/220; 29/889.21

See application file for complete search history.

(56) References Cited

U.S. PATENT DOCUMENTS

| | | | | |
|---|---|---|---|---|
| 2,654,565 | A | 10/1953 | Feilden | |
| 2,861,823 | A | 11/1958 | Perry | |
| 3,680,979 | A | 8/1972 | Hansen et al. | |
| 3,976,399 | A | 8/1976 | Schmoch | |
| 4,247,256 | A | 1/1981 | Maghon | |
| 4,586,225 | A | 5/1986 | Bouiller et al. | |
| 4,611,464 | A | 9/1986 | Hetzer et al. | |
| 4,685,286 | A | 8/1987 | Hetzer et al. | |
| 5,210,945 | A | 5/1993 | Suzuki | |
| 5,220,784 | A | 6/1993 | Wilcox | |
| 5,267,397 | A | 12/1993 | Wilcox | |
| 5,537,814 | A | 7/1996 | Nastuk et al. | |
| 6,267,553 | B1 | 7/2001 | Burge | |
| 6,276,124 | B1 | 8/2001 | Soh et al. | |
| 7,411,328 | B2 * | 8/2008 | Snelick et al. | 310/75 D |

* cited by examiner

*Primary Examiner* — David S Blum

(74) *Attorney, Agent, or Firm* — Norton Rose OR LLP

(57) ABSTRACT

A rotor for a gas turbine engine having a stub shaft and an axis of rotation, the rotor including a turbine hub clamped to a coaxial tie shaft with a tie shaft nut, the stub shaft comprising: a hollow stub shaft body extending rearwardly axially of the turbine; a forward portion of the stub shaft body disposed radially outwardly of the tie shaft nut and removably mounted to a rearward portion of the turbine; and a rearward portion of the stub shaft body including an inner bearing race mounting surface.

20 Claims, 4 Drawing Sheets

ROTOR MOUNTING SYSTEM FOR GAS TURBINE ENGINE

TECHNICAL FIELD

The application relates to gas turbine engines and in particular to rotor mounting system.

BACKGROUND OF THE ART

The high pressure rotor of a conventional gas turbine engine is assembled from discs or hubs in a stack up operation where components such as compressor hubs and turbines are connected coaxially together along the axis of rotation. To clamp the components together axially, a tie shaft or tie rod extends through the inside diameter of the rotor components. The tie shaft is secured at the compressor end of the rotor and extends into the turbine section. A tie shaft nut secures the turbine end of the tie shaft and the stacked components are clamped when the nut is tightened. However, since the tie shaft nut and support bearing are located in the same position, namely at the turbine end of the rotor, there is a conflict between the requirements for optimal bearing designs and the requirements of the tie shaft. Thus, there is room for improvement.

SUMMARY

In accordance with a general aspect of the application, there is provided a gas turbine engine comprising at least one rotor mounted to a shaft having an axis of rotation, the rotor including a disc hub clamped to a coaxial tie shaft with a tie shaft nut, the engine including a stub shaft separate from the disc hub and having a hollow stub shaft body extending rearwardly axially of the disc hub, the stub shaft being disposed outside of a clamping load path of the tie shaft nut, the stub shaft body having a forward portion disposed radially outwardly of the tie shaft nut and removably mounted to a rearward portion of the rotor, a rearward portion of the stub shaft body including an inner bearing race mounting surface, and a bearing having an inner race mounted on said inner bearing race mounting surface of the stub shaft body.

In accordance with another aspect, there is provided a gas turbine engine rotor assembly comprising at least a compressor rotor and a turbine rotor clamped together by a coaxial tie-shaft and a tie shaft nut, a hollow stub shaft removably mounted to said turbine rotor and extending rearwardly therefrom, the tie shaft nut being axially trapped between the stub shaft and the turbine rotor, and a rear bearing mounted on an inner bearing race mounting surface of the hollow stub shaft rearwardly of the tie shaft nut.

In accordance with a further general aspect, there is provided a method of assembling a gas turbine engine rotor, the method comprising the steps of: building a rotor stack; mounting the stack to a shaft; installing a tie nut to secure the stack to the shaft; and then, mounting a stub shaft to the rotor stack behind the clamping nut, the tie nut being trapped between the rotor stack and the stub shaft.

DETAILED DESCRIPTION

Figure 1:
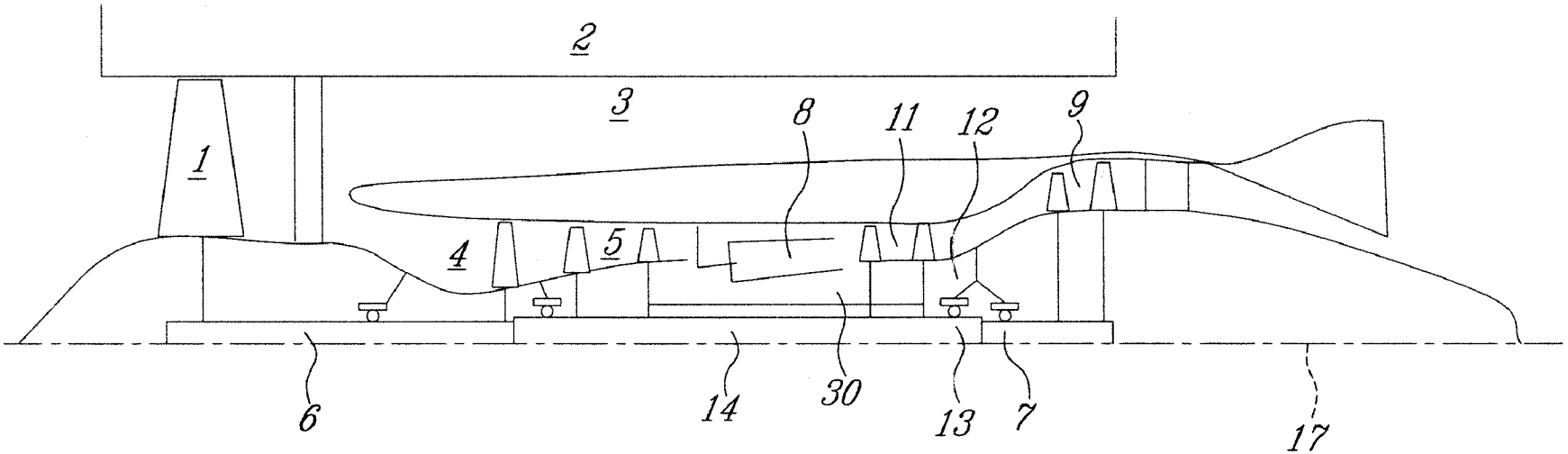
FIG. 1 is an axial cross section through a turbofan turbine engine having a high pressure shaft supported by fore and aft bearings.

FIG. 1 shows an axial cross-section through a turbo-fan gas turbine engine. It will be understood however that the present tie-shaft clamping system is equally applicable to any type of engine such as a turbo-shaft, a turbo-prop, or auxiliary power units. Air intake into the engine passes over fan blades 1 in a fan case 2 and is then split into an outer annular flow through the bypass duct 3 and an inner flow through the low-pressure compressor 4 and high-pressure compressor 5. Compressed air exits the compressor 5 to a combustor 8. Fuel is supplied to the combustor 8, mixed with air and a fuel air mixture is ignited. The hot gases exit from the combustor 8 and pass through turbines 11, 9 before exiting the tail of the engine as exhaust.

Figure 3:
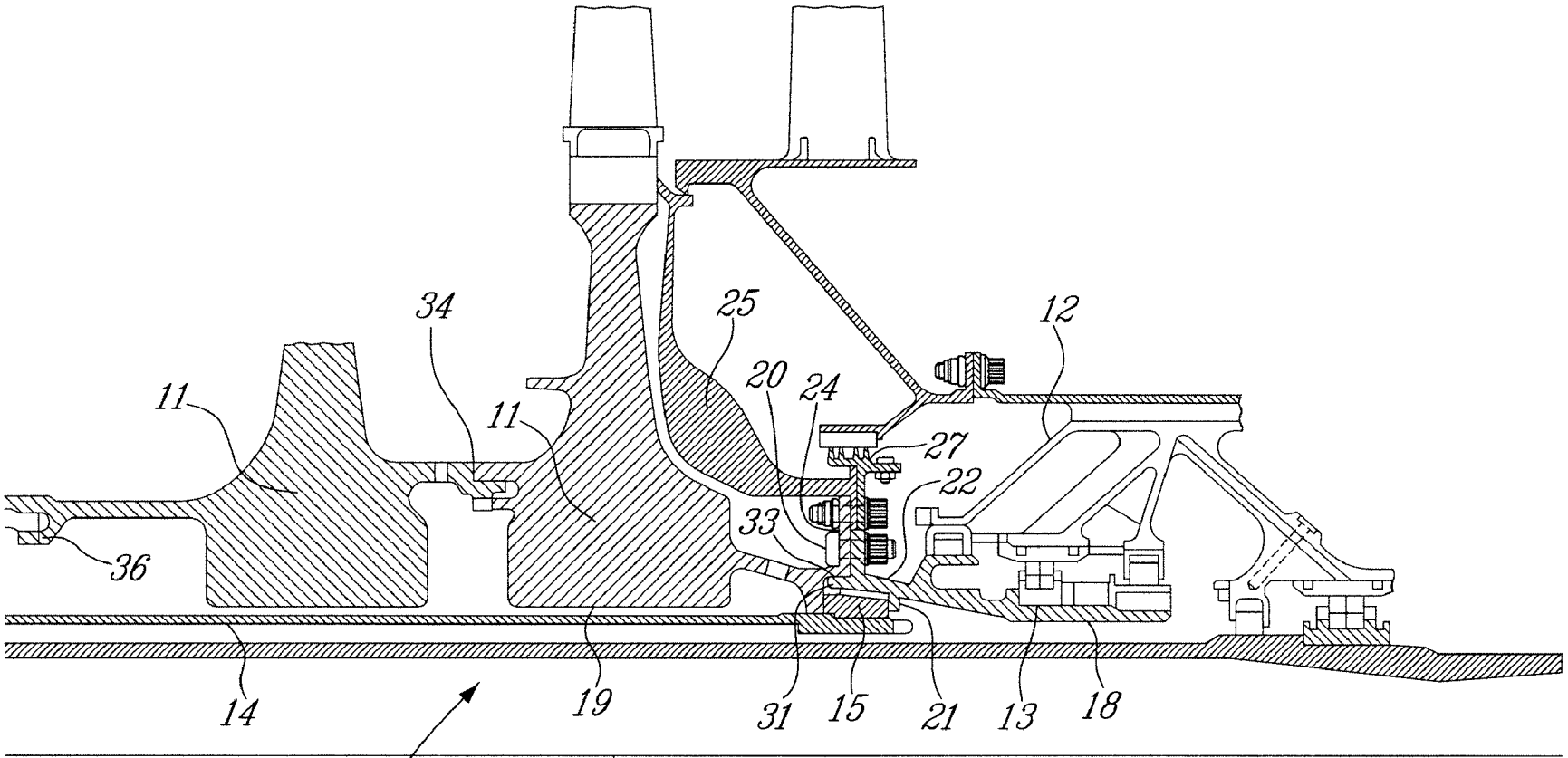
FIG. 3 shows an enlarged sectional view through a portion of the turbine section of the engine shown on FIG. 1.
Figure 4:
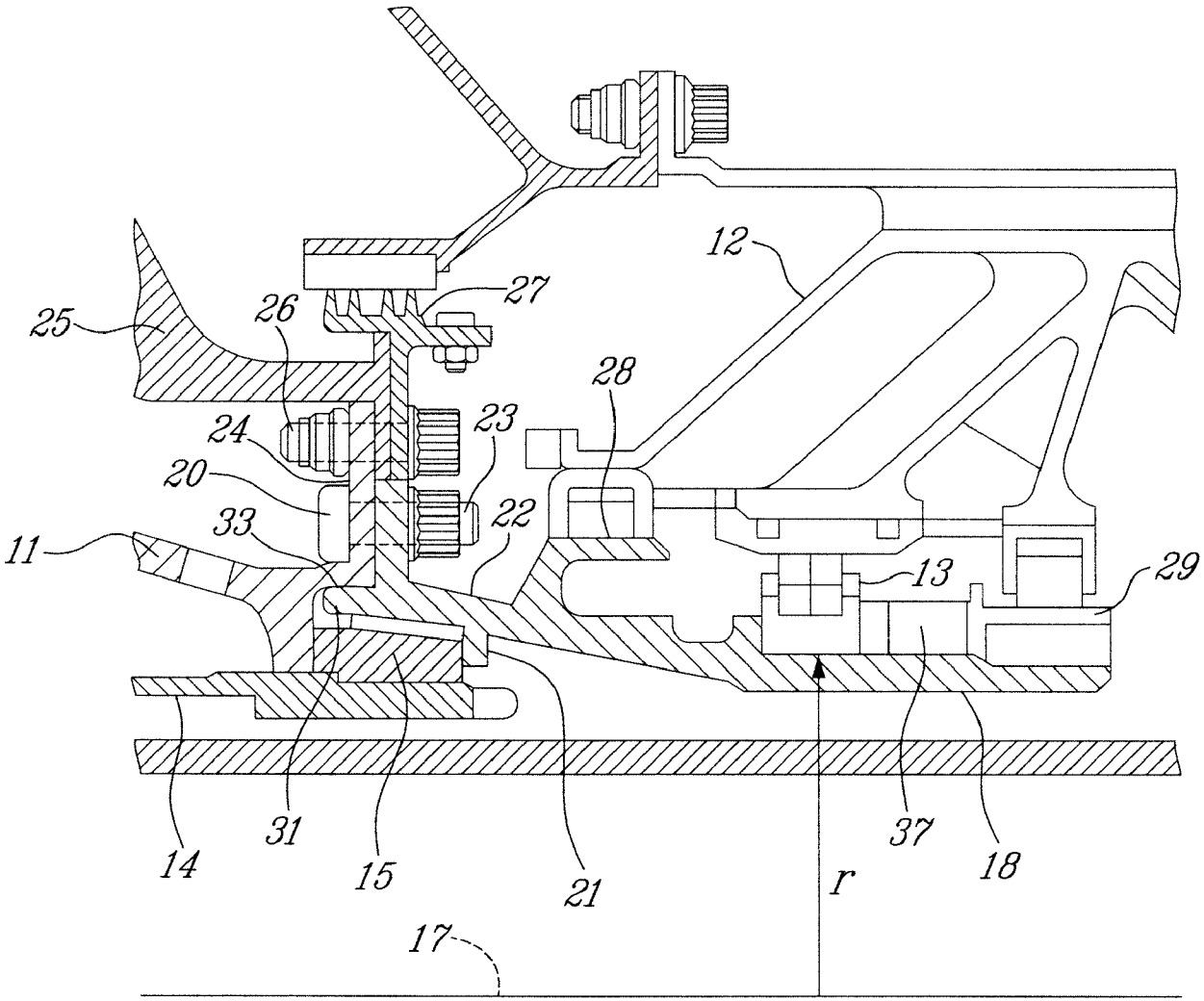
FIG. 4 is a further enlarged detailed view of a detachable stub shaft and clamping arrangement of the turbine section shown on FIG. 3.

Turbines 11 and compressor 5 are mounted to a shaft 14, while turbines 9, compressor 4 and fan 1 are mounted to a shaft 6. Turbines 11 and compressor 5 are also axially connected to one another via a suitable arrangement 30, such as a plurality of spigot arrangements, to provide a high pressure turbine rotor stack or pack 16 (FIGS. 3 and 4). FIG. 1 shows an engine which has a so-called straddle mounted high pressure shaft 14, wherein there is a bearing 13 immediately behind the high pressure turbine rotor, which can cause difficulties for mounting the rotor to the shaft. As the high turbine rotor stack is designed to sustain high rotational speeds for engine efficiency, there is a need to minimize the bearing diameter. The need for small diameter bearings is in conflict with the need to have larger diameter bearings in order to sustain the high axial clamping loads exerted on the inner race of the rear bearing of the high pressure turbine stack. Furthermore, the axial clamping loads on the rear bearings tend to vary during operation of the engine, thereby leading to varying distortions in the bearings. Such load variations in the bearings are undesirable because they may subject the bearings to increased wear. The axial load changes the bearing inner fits which may negatively affect the high pressure turbine rotor stack dynamics during engine operation. Moving the bearings radially out of the load path, however, means the bearings will have a relatively larger radius, which is not suitable in view of the high rotational speed of the high pressure turbine rotor stack.

Figure 2:
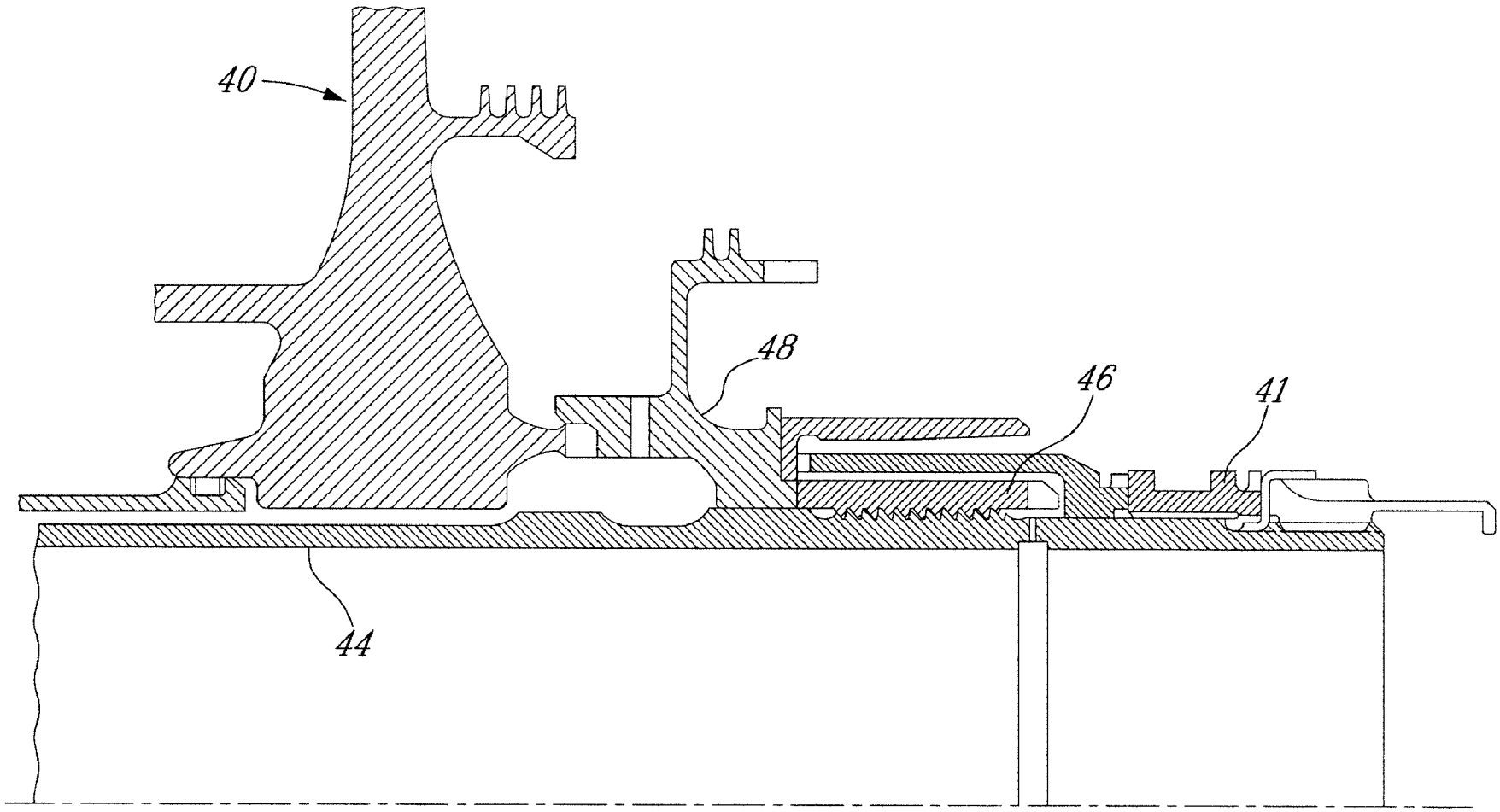
FIG. 2 (PRIOR ART)
FIG. 2 is an axial section through a prior art tie shaft arrangement of a gas turbine engine.

FIG. 2 correspond to FIG. 4 of U.S. Pat. No. 5,537,814 and illustrate one prior art attempt to satisfy the above mentioned conflicting needs. As can be appreciated from FIG. 2, the inner race 41 of the high pressure rotor rear bearing is located axially rearwardly of the tie shaft clamping nut 46 used to axially clamp the turbine disc 40 together with the other rotor components (not shown) and is thus outside of the rotor tie shaft compression load path. While the rear bearing is located outside of the compression load path, the bearing inner race 41 is mounted directly on the tie shaft 44 and not on the turbine rotor 40. This implies that the bearing inner fit will continuously vary depending on the tie shaft variable compression load during engine run. Such fit variations create frictions between the bearing inner race 41 and the tie shaft 44, which may lead to premature wear. Also, rotor stack concentricity may be more difficult to achieve with the rear bearing mounted on the tie shaft 44.

Furthermore, as can be appreciated from FIG. 2, the clamping nut 46 axially clamps a turbine rear shaft 48 against a rear face of the turbine disc 40. The turbine rear shaft 48 is thus part of the high pressure stack. This implies that the turbine rear shaft 48 has to be installed before nut 46. A separate anti-rotation feature must thus be provided in addition to the rear turbine shaft 48 in order to prevent loosening of nut 46.

FIGS. 3 and 4 illustrate the aft end of the high pressure rotor stack 16 for the gas turbine engine of FIG. 1. The high pressure rotor stack 16 has an axis of rotation 17 and includes a separate hollow stub shaft 18 that extends rearwardly axially from the last stage of the high pressure turbines 11. The rotor stack 16 includes a plurality of axially stacked rotor components, including among others last stage turbine rotor disc 19, that are clamped to a coaxial tie shaft 14 with a tie shaft nut 15. The various stages of the high pressure turbine 11 are connected by spigot connections, such as the one shown at 34 in FIG. 3, and by another spigot connection 36 to the high pressure compressor 5 (FIG. 1), to provide the high pressure turbine pack or stack 16. The engine is assembled first by building this stack, balancing it, and then assembling it over the shafts.

A forward portion of a stub shaft 18 is then disposed radially outwardly of the tie shaft nut 15 and is removably mounted to a rearward portion of the last rotor disc 19 of the high pressure turbine 11 with removable fasteners such as bolts 20 shown in FIGS. 3 and 4. The forward portion of the stub shaft 18 comprises a front cylindrical projection 31 adapted to be matingly fitted in a corresponding cylindrical recess 33 defined in a rearwardly projecting part of the turbine disc 19 to form a spigot connection between the stub shaft 18 and the last turbine disc 19. A rearward portion of the stub shaft 18 includes an inner bearing race mounting surface for accommodating the rear bearings 13 of the high pressure stack 16. Therefore, the axial load imposed by the tie shaft nut 15 does not pass through the bearings 13 but rather is applied directly to the turbine rotor components without passing through the bearings 13.

The tie shaft nut 15 may require some form of anti-rotation or locking device to maintain the clamping force and prevent unintentional loosening of the nut 15. In the embodiment illustrated, the forward portion of the stub shaft 18 includes a tie shaft nut lock in the form of a radially projecting abutment tab 21 rearward of the tie shaft nut 15. Therefore, when the bolts 20 are secured, rotation of the tie shaft nut 15 is prevented by interference with the tab 21. Other suitable anti-rotation engagement, such as of the slot and dog type, can be provided between the stub shaft 18 and nut 15.

The forward portion of the stub shaft 18 includes a bell mouth 22 that surrounds the tie shaft nut 15. Around the bell mouth 22 is a radially projecting flange 23 that matches a radially extending flange 24 providing a turbine connection surface. In the embodiment shown, the turbine flange 24 and the stub shaft flange 23 both include holes for threaded fasteners such as the bolts 20 to extend through. However, alternative arrangements could include a threaded stud on either flange 23 and 24 which could extend through the opposing flange and be secured with a nut.

The turbine rotor stack 16 also includes a rear cover plate 25 and the turbine flange 24 includes a cover plate mounting surface through which bolt 26 extends to secure the cover plate 25 and runner 27. The stub shaft flange 23 can also provide a mounting surface for the rear cover plate 25 and runner 27. In this way, the cover plate 25 can be assembled to the turbine rotor with a constant axial preload throughout the engine operation for its proper function.

As best seen in FIG. 4, the stub shaft 18 also includes a liquid lubricant seal runner 28 forward of the inner bearing race mounting surface. The stub shaft 18 also has a liquid lubricant seal runner 29 rearward of the inner bearing race mounting surface. In this manner, liquid lubricant can be contained within the bearing chamber 12.

A rear bearing locknut 37 (not the tie shaft locknut 15) generates constant compression load on the inner race of the high pressure rotor rear bearing 13 assuring constant bearing inner fits throughout whole engine operation. The dissociation of the rear bearing from the tie shaft and rotor clamping load path thus prevent undesirable bearing inner fit variations during engine operation.

The rearward portion of the stub shaft 18 is disposed radially inwardly from the forward portion of the stub shaft 18 adjacent the bell mouth 22. Advantageously, the forward portion of the stub shaft 18 surrounds the tie shaft nut 15 and the bell mouth 22 has an inner surface of radius larger than the inner bearing race mounting surface radius r. Accordingly, the internal radius r of the inner bearing race of bearing 13 can be positioned as closed as possible to the axis of rotation 17. The bell mouth 22 and tapering of the stub shaft 18 enables use of bearings 13 having a relatively small radius r.

Therefore, the bearing 13 can be positioned out of the tie shaft clamping load path imposed by the tie shaft nut 15. Further, the stub shaft 18 provides nesting around the tie shaft nuts and locking with the tab 21 to prevent rotation of the nut 15. The inter-engaging flanges 23 and 24 ensure that the stub shaft 18 maintains a relatively high bending strength for the rotor and does not compromise the strength of the rotor during turbine blade off events which impose high bending stresses. The bolted on stub shaft assures high rotor integrity in a turbine blade off situation when high bending moment is transmitted, preventing the turbine and stub shaft interface flange separation.

Further, the stub shaft 18 facilitates rotor balancing and simplifies clamping of the rotor components with the tie shaft nut 15 that can be installed before the stub shaft 18 and bearings 13. Mounting of rear bearing 13 on the stub shaft 18 provides for high rotor stack concentricity and superior rotor stiffness over a mounting arrangement wherein the rear bearing sits on the tie shaft instead of the rotor. The separate stub shaft controlled geometry allows for angular timing at rotor assembly.

The above description is meant to be exemplary only, and one skilled in the art will recognize that changes may be made to the embodiments described without departing from the scope of the invention disclosed. For example, although described with reference to a turbine disc tie arrangement, the present approach may also be suitable applied to a compressor rotor. The approach may applied in any suitable gas turbine engine, and is not limited to a turbofan engine, nor an engine having the particular configuration, number of stages, etc. described above. The configuration of the stub shaft may vary depending on the intended application. Still other modifications which fall within the scope of the present invention will be apparent to those skilled in the art, in light of a review of this disclosure, and such modifications are intended to fall within the appended claims.

What is claimed is:

1. A gas turbine engine comprising at least one rotor mounted to a shaft having an axis of rotation, the rotor including a disc hub clamped to a coaxial tie shaft with a tie shaft nut, the engine including a stub shaft separate from the disc hub and having a hollow stub shaft body extending rearwardly axially of the disc hub, the stub shaft being disposed outside of a clamping load path of the tie shaft nut, the stub shaft body having a forward portion disposed radially outwardly of the tie shaft nut and removably mounted to a rearward portion of the rotor, a rearward portion of the stub shaft body including an inner bearing race mounting surface, and a bearing having an inner race mounted on said inner bearing race mounting surface of the stub shaft body.

2. The engine of claim 1 wherein the forward portion of the stub shaft body includes a tie shaft nut lock.

3. The engine of claim 2 wherein the forward portion of the stub shaft comprises a radially projecting abutment tab rearward of the tie shaft lock nut.

4. The engine of claim 2 wherein the forward portion of the stub shaft body includes a bell mouth surrounding the tie shaft lock nut.

5. The engine of claim 1 wherein a rearward portion of the disc hub includes a connection surface and the forward portion of the stub shaft body matches the connection surface.

6. The engine of claim 5 wherein the connection surface comprises a radially extending flange and the forward portion of the stub shaft body includes a matching flange.

7. The engine of claim 6 wherein at least one of the radially extending flange of the disc hub and the stub shaft body flange include threaded fastener holes.

8. The engine of claim 6 wherein the radially extending flange includes a turbine cover plate mounting surface.

9. The engine of claim 5 wherein the rearward portion of the stub shaft includes a liquid lubricant seal runner disposed at least one of: forward of the inner bearing race mounting surface; and rearward of the inner bearing race mounting surface.

10. The engine of claim 1 wherein the rearward portion of the stub shaft body is disposed radially inwardly of the forward portion of the stub shaft body.

11. The engine of claim 10 wherein the forward portion of the stub shaft includes a bell mouth trapping the tie shaft nut, the bell mouth having an inside surface, and wherein the inner bearing race mounting surface is disposed radially inwardly of the bell mouth inside surface.

12. A gas turbine engine rotor assembly comprising at least a compressor rotor and a turbine rotor clamped together by a coaxial tie-shaft and a tie shaft nut, a hollow stub shaft removably mounted to said turbine rotor and extending rearwardly therefrom, the tie shaft nut being axially trapped between the stub shaft and the turbine rotor, and a rear bearing mounted on an inner bearing race mounting surface of the hollow stub shaft rearwardly of the tie shaft nut.

13. The rotor assembly of claim 12, wherein the hollow stub shaft has a radially inner surface with an annular abutment tab projecting inwardly therefrom in anti-rotation engagement with the tie shaft nut.

14. The rotor assembly of claim 12, wherein the hollow stub shaft has a bell mouth surrounding the tie shaft nut.

15. The rotor assembly of claim 12, wherein the turbine rotor has a radially extending flange, the hollow stub shaft being provided at a forward end thereof with an associated flange.

16. The rotor assembly of claim 15, wherein the turbine flange and the stub shaft flange are bolted to one another.

17. The rotor assembly of claim 15, wherein a rear turbine cover plate is bolted to the stub shaft flange.

18. The rotor assembly of claim 12, wherein the stub shaft has a forward bell mouth surrounding the tie shaft nut, the bell mouth having an inside surface, and wherein the inner bearing race mounting surface is disposed radially inwardly of the bell mouth inside surface.

19. A method of assembling a gas turbine engine rotor, the method comprising: the steps of building a rotor stack; mounting the stack to a shaft; installing a tie nut to secure the stack to the shaft; and then, mounting a stub shaft to the rotor stack behind the clamping nut, the tie nut being trapped between the rotor stack and the stub shaft.

20. The method further comprising mounting a bearing on the stub shaft.

* * * * *